US006232586B1

(12) United States Patent
Eskildsen

(10) Patent No.: US 6,232,586 B1
(45) Date of Patent: May 15, 2001

(54) CORE STRUCTURE FOR AN INDUCTION HEATING ELEMENT

(75) Inventor: Christian Eskildsen, Gelsted (DK)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/380,320

(22) PCT Filed: Mar. 13, 1998

(86) PCT No.: PCT/DK98/00096

§ 371 Date: Oct. 14, 1999

§ 102(e) Date: Oct. 14, 1999

(87) PCT Pub. No.: WO98/41061

PCT Pub. Date: Sep. 17, 1998

(30) Foreign Application Priority Data

Mar. 13, 1997 (DK) ..... 0282/97

(51) Int. Cl.[7] ..... H05B 6/10
(52) U.S. Cl. ..... 219/622; 219/624; 219/670
(58) Field of Search ..... 219/624, 623, 219/622, 621, 670, 676, 675, 672

(56) References Cited

U.S. PATENT DOCUMENTS

| | | | | |
|---|---|---|---|---|
| 3,949,183 | | 4/1976 | Usami et al. . | |
| 4,467,162 | * | 8/1984 | Konda et al. | 219/624 |
| 4,527,031 | * | 7/1985 | Aparicio | 219/622 |
| 4,789,767 | * | 12/1988 | Doljack | 219/670 |
| 5,690,851 | * | 11/1997 | Yoshioka et al. | 219/624 |

FOREIGN PATENT DOCUMENTS

| | | | | |
|---|---|---|---|---|
| 44 29 183 A1 | | 2/1996 | (DE) . | |
| 762183 | * | 4/1934 | (FR) | 219/624 |
| WO 94/05137 | * | 3/1994 | (WO) | 219/624 |

* cited by examiner

*Primary Examiner*—Philip H. Leung
(74) *Attorney, Agent, or Firm*—Pearne & Gordon LLP

(57) ABSTRACT

A dish-shaped core for an induction heating apparatus is provided with rim parts which present a large area to the edge of the cooking vessel. These rim parts are obtained by means of a slanted cut of the rim or by slanting the rim itself inwards. The leakage flux is reduced because the edge of the cooking vessel acts as an "attractor" for the flux lines emanating from the core.

5 Claims, 1 Drawing Sheet

CORE STRUCTURE FOR AN INDUCTION HEATING ELEMENT

The invention relates to a core structure for an induction heating element for use in a cooker for food.

Induction heating coils are well-known, comprising as a minimum a flat "pancake" coil fitted below and parallel to the cooking vessel. The magnetic field around such a coil has large stray field which does not contribute to the heating but rather heats up irrelevant metal parts. In order to improve the situation it is known to place a number of radially disposed ferrite rods on the underside of the coil. In order to further improve the functioning of this heating method, a more complete core structure is known, being constituted of a shallow dish-shaped structure having an upwards-facing rim and a central pole piece.

Particular losses are occuring because of the stray field at the junction between the rim and the cooking vessel. This stray field is considered undesired and it is also under regulation in that it is considered that it should exceed a certain maximum value. There is hence a need to improve the magnetic coupling between the core and the cooking vessel. The problem is that without forcing the consumer to use cooking vessels constructed in a particular manner, it is only possible to use a change in the disposition of the core as a parameter.

According to the invention a reduction of leakage flux is obtained by means of a rim structure which presents a large area towards the lower edge of the cooking vessel. This has the effect that the edge of the cooking vessel acts as an "attractor" for flux lines, and hence reduces the flux which has to take a lengthy path via the air. The pole piece area will in practice be greater than the cross sectional area of the rim itself, and this may e.g. be obtained by means of a slanted cut of the rim.

In one advantageous embodiment of the invention, the mean diameter of the rim has essentially the same diameter as the cooking vessel and the outer edge of the rim is raised above the inner edge.

In a further embodiment of the invention both the lower and the upper edge of the rim are disposed above the level of the cooktop. In this manner, an automatic centering of a cooking vessel is obtained, and the bottom of the cooking vessel is raised above the level of the cooktop which prevents conductive heating of the cooktop and the coil below the surface. Preferentially the outer edge of the rim is rounded.

In a further advantageous embodiment of the invention the rim of the core is inwards slanted and has a maximum diameter which corresponds to the cooking vessel. In this embodiment, the slanted rim is cut off horizontally, and the core surface is essentially flush with or raised slightly above the cooktop surface. The area presented to the edge of the cooking vessel is actually the outer side of the inwards slanting rim part.

Figure 1:
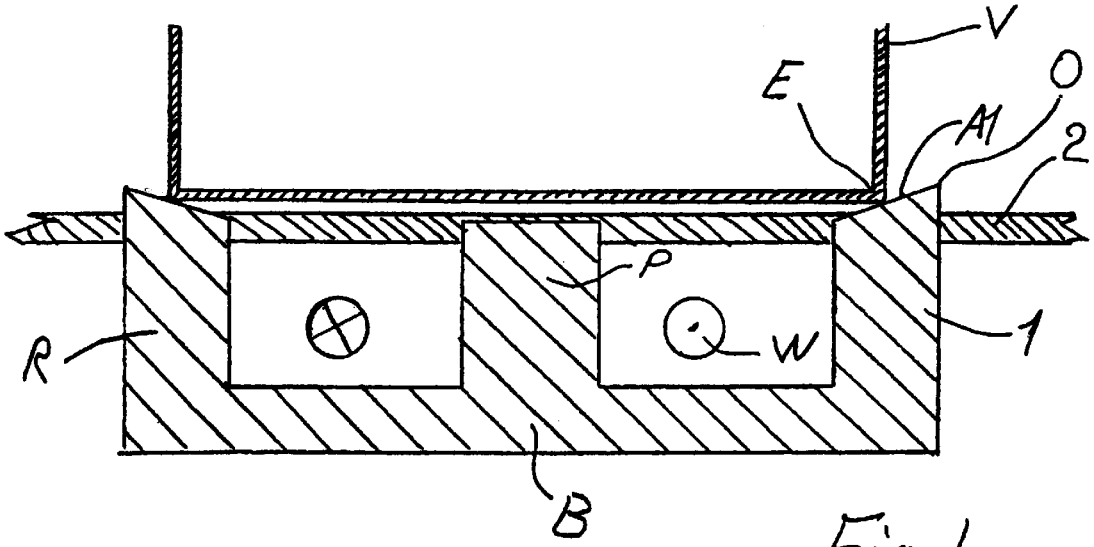
Figure 2:
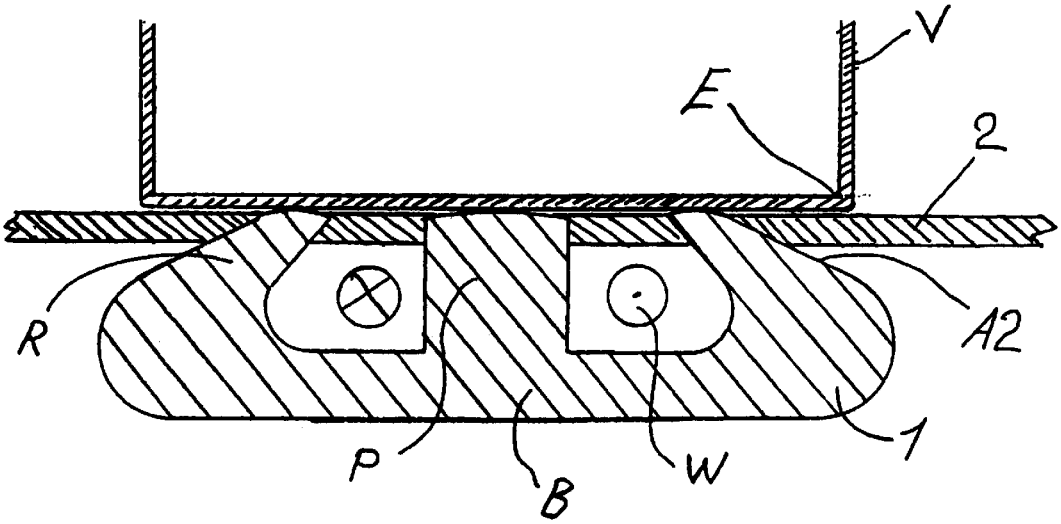

The invention will be described in greater detail with reference to the drawing in which FIG. 1 shows an embodiment with inwards slanting top of the rim, and FIG. 2 shows another embodiment where the rim itself is slanting.

In FIG. 1 is shown a core structure 1 which partly penetrates a cooktop surface layer 2. The core structure consists of a rim R, a bottom B and a central pole P. An essentially toroidal cavity contains a winding W which is one or several layers constituting a disc-shaped coil concentric with the pole P.

The rim R is in the form of a cylindrical shell, howver seen in a section as shown it is cut of obliquely at the top, i.e. the edge of the rim is part of a conical surface A1. This surface presents a larger area than would a plane section of the cylindrical rim. The surface A1 faces the edge E of a cooking vessel V, which contains ferromagnetic material, and the flux lines exiting from the surface A1 is drawn towards the concentration of ferromagnetic material at the edge E. This reduces the stray flux around the core/cooking vessel union established, and hence increases efficiency. Provided the rim is sufficiently thick, a plane section would provide a similar field distribution, however the inwards facing surface A1 ensures centering of the cooking vessel V on the core. Furthermore, the fact that the edge E rides on the surface A1 means that there is an airgap below the cooking vessel which creates heat insulation so that the core 1 and winding W do not receive heat conducted from the heated cooking vessel. The outer edge O of the rim may advantageously be rounded in order to increase cleanibility, and the central pole P may be extended to almost touching the cooking vessel, possibly having a rounded top surface, again to increase cleanability.

In FIG. 2 a different embodiment of a core according to the invention is shown. The reference numerals are as for FIG. 1, however the part of the core interacting with the edge E of the cooking vessel V is not the top of the rim but rather the outside surface A2 of the inwards slanting rim R. This surface A2 is in practice essentially conical, although a smooth rounding is also perfectly feasible. All the parts which penetrate the cooktop surface 2 are rounded in order to improve cleanability. The core is preferably moulded in a material which is either a polymer or a densit material loaded with ferromagnetic particles, such as ferrite which has a high permeability. The winding W is surrounded by an insulating material which is cast in situ.

What is claimed is:

1. An induction heating system comprising:

a cooking vessel having a bottom edge;

a support surface for supporting the cooking vessel;

a heating apparatus comprising a core member disposed at least partially below the support surface; and the core member comprising a rim, a bottom, and a central pole piece, the rim comprising an outer edge and an inner edge;

wherein the bottom edge of the cooking vessel lies substantially between the inner edge of the rim and the outer edge of the rim when the cooking vessel is supported on the support surface, and wherein magnetic flux lines generated by the heating apparatus must pass through air before reaching the cooking vessel.

2. An induction heating system according to claim 1, wherein a diameter of the bottom edge of the cooking vessel is substantially equal to a mean of respective diameters of the outer and inner edges of the rim.

3. An induction heating system according to claim 1, wherein a diameter of the outer edge of the rim is substantially equal to a diameter of the bottom edge of the cooking vessel.

4. An induction heating system according to claim 1, wherein the outer edge of the rim is raised above the inner edge of the rim.

5. An induction heating system according to claim 1, wherein the inner edge of the rim is raised above the outer edge of the rim.

* * * * *